US009525224B1

(12) United States Patent
Jiang et al.

(10) Patent No.: US 9,525,224 B1
(45) Date of Patent: Dec. 20, 2016

(54) ELECTRICAL CONNECTOR AND ELECTRONIC SYSTEM

(71) Applicant: HON HAI PRECISION INDUSTRY CO., LTD., New Taipei (TW)

(72) Inventors: Yi-Sing Jiang, New Taipei (TW); Yi-Sheng Cheng, New Taipei (TW); Chia-Ao Chu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/816,483

(22) Filed: Aug. 3, 2015

(51) Int. Cl.
*H01R 12/00* (2006.01)
*H01R 12/70* (2011.01)

(52) U.S. Cl.
CPC ..... *H01R 12/7076* (2013.01)

(58) Field of Classification Search
CPC ... H01R 23/722; H01R 23/725; H05K 7/1069; H05K 7/1084
USPC ..... 439/66, 68, 70, 74
See application file for complete search history.

(56) References Cited

U.S. PATENT DOCUMENTS 5,281,149 A * 1/1994 Petri ..... H05K 7/142 174/138 D
5,885,092 A * 3/1999 Ito ..... H01R 12/716 439/74
6,038,140 A * 3/2000 Petri ..... H05K 7/142 174/138 G
6,065,977 A * 5/2000 Toda ..... H01R 12/714 361/799
6,135,792 A * 10/2000 Kuo ..... G06K 7/0013 439/92
6,485,312 B1 * 11/2002 Yu ..... H01R 12/716 439/74
6,739,880 B2 * 5/2004 Toyota ..... H01R 12/523 174/138 G
7,632,104 B2 * 12/2009 Liao ..... H01R 12/73 439/65
7,811,094 B2 * 10/2010 Kuwahara ..... H01R 13/2407 439/66
7,931,477 B2 * 4/2011 Hirata ..... H01R 12/716 439/74

(Continued)

FOREIGN PATENT DOCUMENTS

CN 104638444 A 5/2015
TW M364326 U1 9/2009

*Primary Examiner* — Thanh Tam Le
(74) *Attorney, Agent, or Firm* — Zhigang Ma

(57) ABSTRACT

An electrical connector includes an insulating housing and a plurality of terminals coupled to the insulating housing. The insulating housing includes a positioning body, a head portion extending from a first face of the positioning body, and a tail portion extending from a second face of the positioning body. Each terminal includes a first contact portion, a second contact portion, and a retaining portion between the first contact portion and the second contact portion. The retaining portion includes a first coupling portion coupled to the first contact portion and a second coupling portion between the first coupling portion and the second contact portion. The first coupling portion and the second coupling portion are noncoplanar. The first contact portion is coupled to the head portion, the second contact portion is coupled to the tail portion. The retaining portion extends from the head portion to the tail portion.

19 Claims, 9 Drawing Sheets

(56) References Cited

U.S. PATENT DOCUMENTS 8,118,604 B2 * 2/2012 Ma ..... H01R 12/714
439/66
8,992,233 B2 * 3/2015 Miyazaki ..... H01R 12/707
439/74

* cited by examiner

ELECTRICAL CONNECTOR AND ELECTRONIC SYSTEM

FIELD

The subject matter herein generally relates to an electrical connector and an electronic system with the electrical connector.

BACKGROUND

Electrical connectors are widely used in various computer systems, mobile phones or other electronic system for forming electrical connection between two separate electrical interfaces, such as between an electronic component and a circuit board, between a circuit board and another circuit board, between an integrated circuit and a circuit board, or between two electronic components.

BRIEF DESCRIPTION OF THE DRAWINGS

Implementations of the present technology will now be described, by way of example only, with reference to the attached figures.

DETAILED DESCRIPTION

Figure 1:
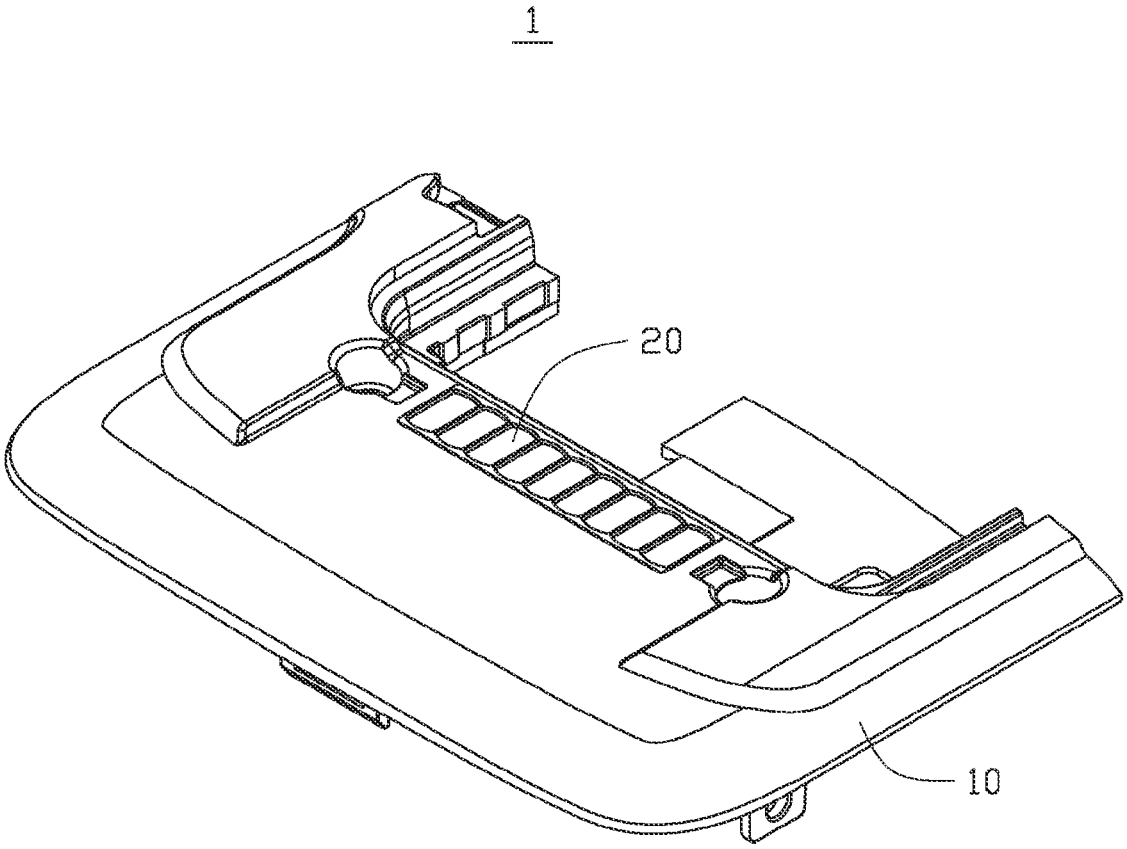
FIG. 1 is an isometric view of an electronic system in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure is described in relation to an electrical connector. The electrical connector can include an insulating housing and a plurality of terminals coupled to the insulating housing. The insulating housing can include a positioning body, a head portion extending from a first face of the positioning body, and a tail portion extending from a second face of the positioning body opposite to the first face. Each of the terminals can include a first contact portion configured to be coupled to a first circuit board or electronic device, a second contact portion configured to be coupled to a second circuit board or electronic device, and a retaining portion coupled between the first contact portion and the second contact portion. The retaining portion can include a first coupling portion coupled to the first contact portion and a second coupling portion coupled between the first coupling portion and the second contact portion. The first coupling portion and the second coupling portion are noncoplanar. The first contact portion is coupled to a first positioning face of the head portion of the insulating housing. The second contact portion is coupled to a second positioning face of the tail portion of the insulating housing, and the retaining portion extends from the head portion to the tail portion.

The present disclosure is described further in relation to an electronic system. The electronic system can include an installing housing and an electrical connector coupled to the installing housing. The installing housing can include a support face, an opening on the support face and a through hole below the support face and communicating with the opening. The electrical connector can include an insulating housing and a plurality of terminals coupled to the insulating housing. The insulating housing can include a positioning body positioned on the support face and received in the opening, a head portion extending from a first face of the positioning body and received in the opening, and a tail portion extending from a second face of the positioning body opposite to the first face and received in the through hole. Each of the terminals can include a first contact portion configured to be coupled to a first circuit board or electronic device, a second contact portion configured to be coupled to a second circuit board or electronic device, and a retaining portion coupled between the first contact portion and the second contact portion. The first contact portion is coupled to a face of the head portion of the insulating housing, the second contact portion is coupled to a face of the tail portion of the insulating housing, and the retaining portion extends from the head portion to the tail portion.

FIG. 1 illustrates an electronic system 1 of an embodiment of the present disclosure. The electronic system 1 can include an installing housing 10 and an electrical connector 20 coupled to the installing housing 10.

Figure 2:
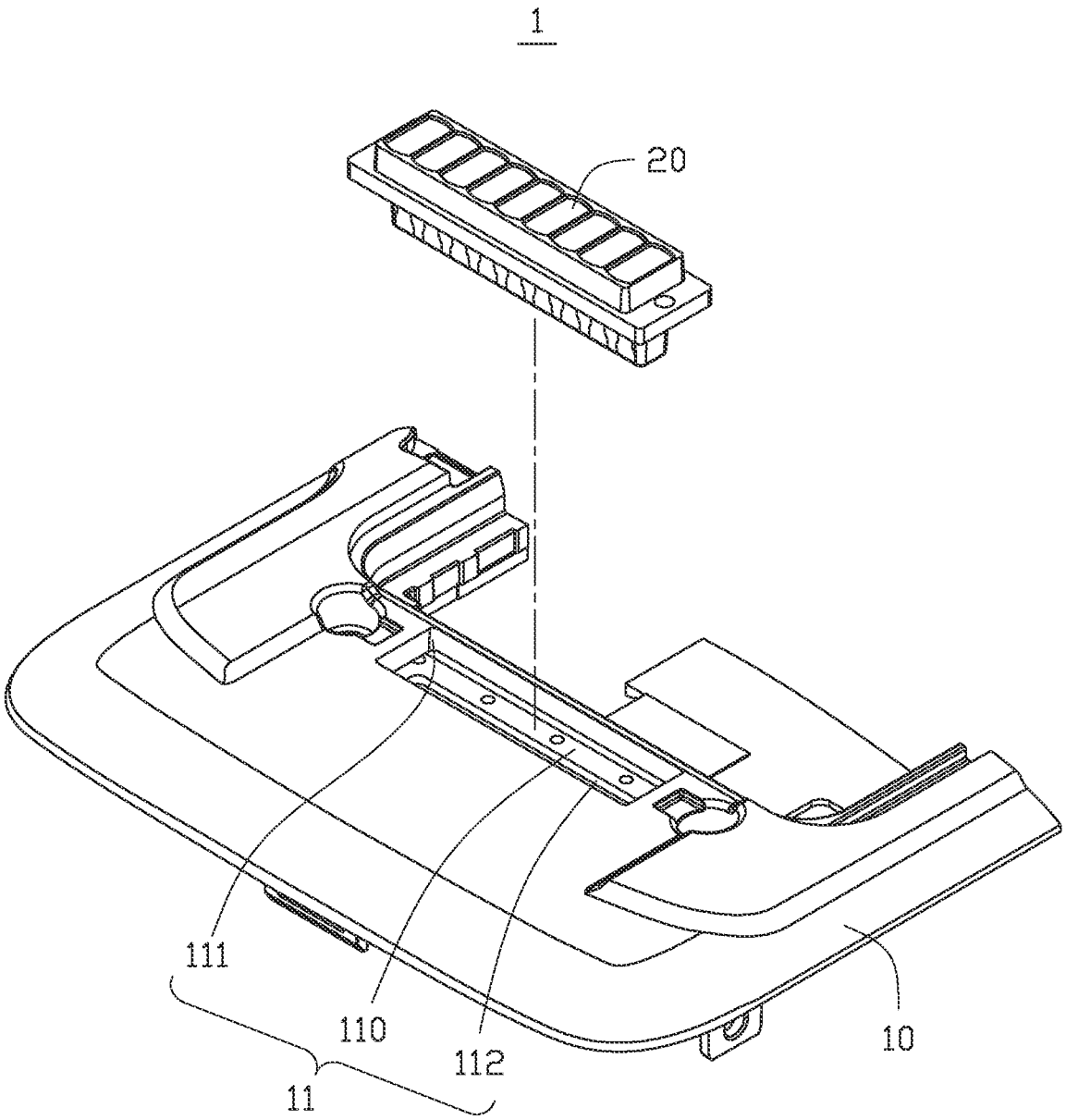
FIG. 2 is an exploded, isometric view of the electronic system in FIG. 1.

FIG. 2 illustrates that the installing housing 10 can define a counterbore structure 11 configured to couple with the electrical connector 20. The conterbore structure 11 can include a support face 110, an opening 111 on the support face 110 and a through hole 112 below the support face 110 and communicating with the opening 111. The opening 111 is greater than the through hole 112 in size. In at least one embodiment, the support face 110 is rectangular in shape. The opening 111 is rectangular in shape. The through hole 112 is rectangular in shape.

Figure 3:
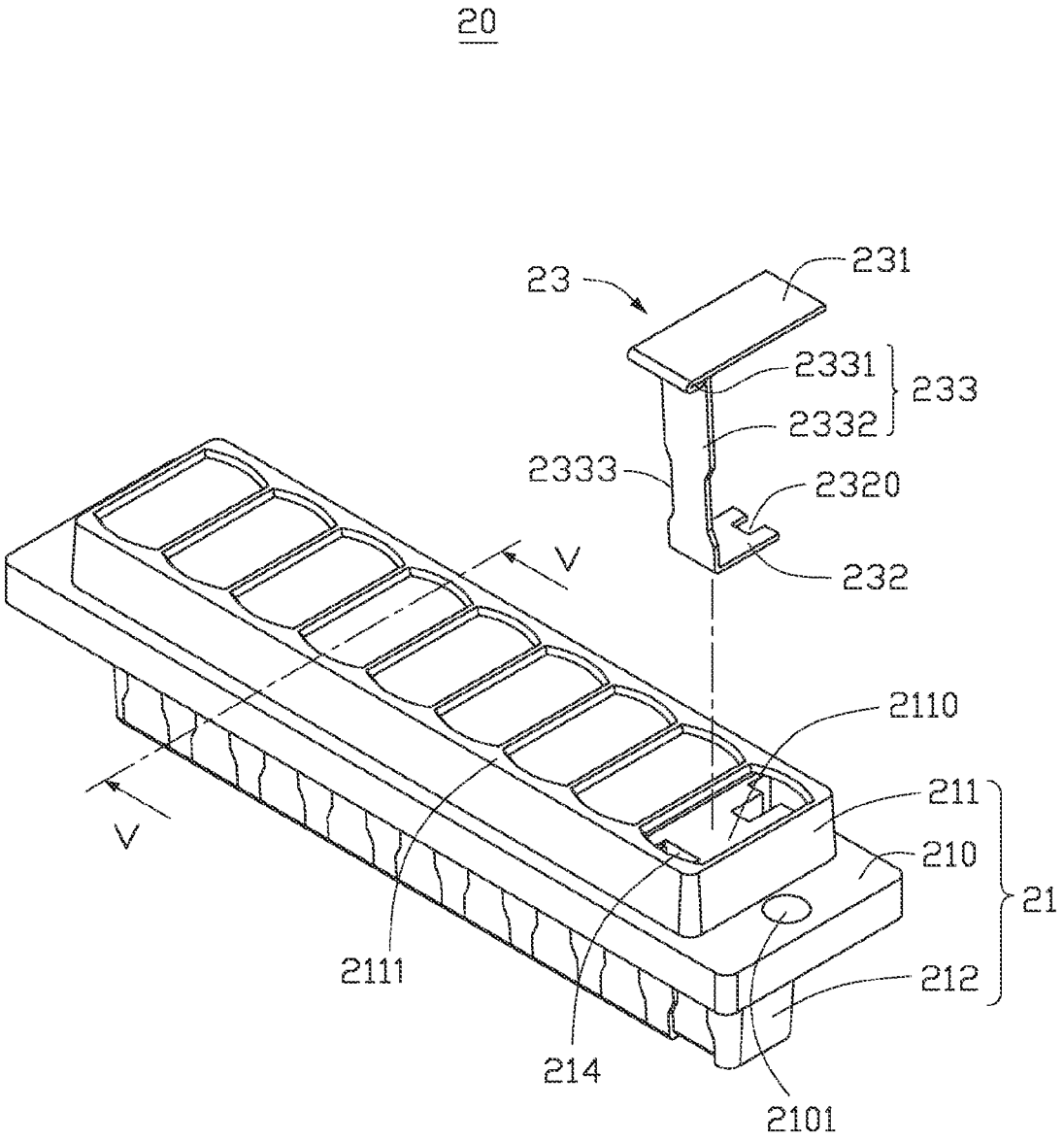
FIG. 3 is an exploded, isometric view of an electrical connector of the electronic system in FIG. 2.

FIG. 3 illustrates that the electrical connector 20 can include an insulating housing 21 and a plurality of first terminals 23 received in the insulating housing 21.

The insulating housing 21 can include a positioning body 210, a head portion 211 extending from a first face of the positioning body 210, and a tail portion 212 extending from a second face of the positioning body 210. The first face is opposite to the second face. The positioning body 210 has a size greater than that of each of the head portion 211 and the tail portion 212. The head portion 211 can have a size greater than that of the tail portion 212. The positioning body 210 can define two through apertures 2101 extending through the first face and the second face at two opposite end portions thereof. The head portion 211 can define a first concave face 2110 at a first positioning face 2111 thereof remote from the positioning body 210. The tail portion 212 can define a second concave face 2120 (shown in FIG. 4) at a second positioning face 2121 thereof remote from the positioning body 210. The first positioning face 2111 of the head portion 211 is substantially parallel to the second positioning face 2121 of the tail portion 212.

The insulating housing 21 defines a plurality of passageways 214, for receiving a corresponding number of the first terminals 23 therein, extending through the insulating housing 21 from the head portion 211 to the tail portion 212.

Figure 4:
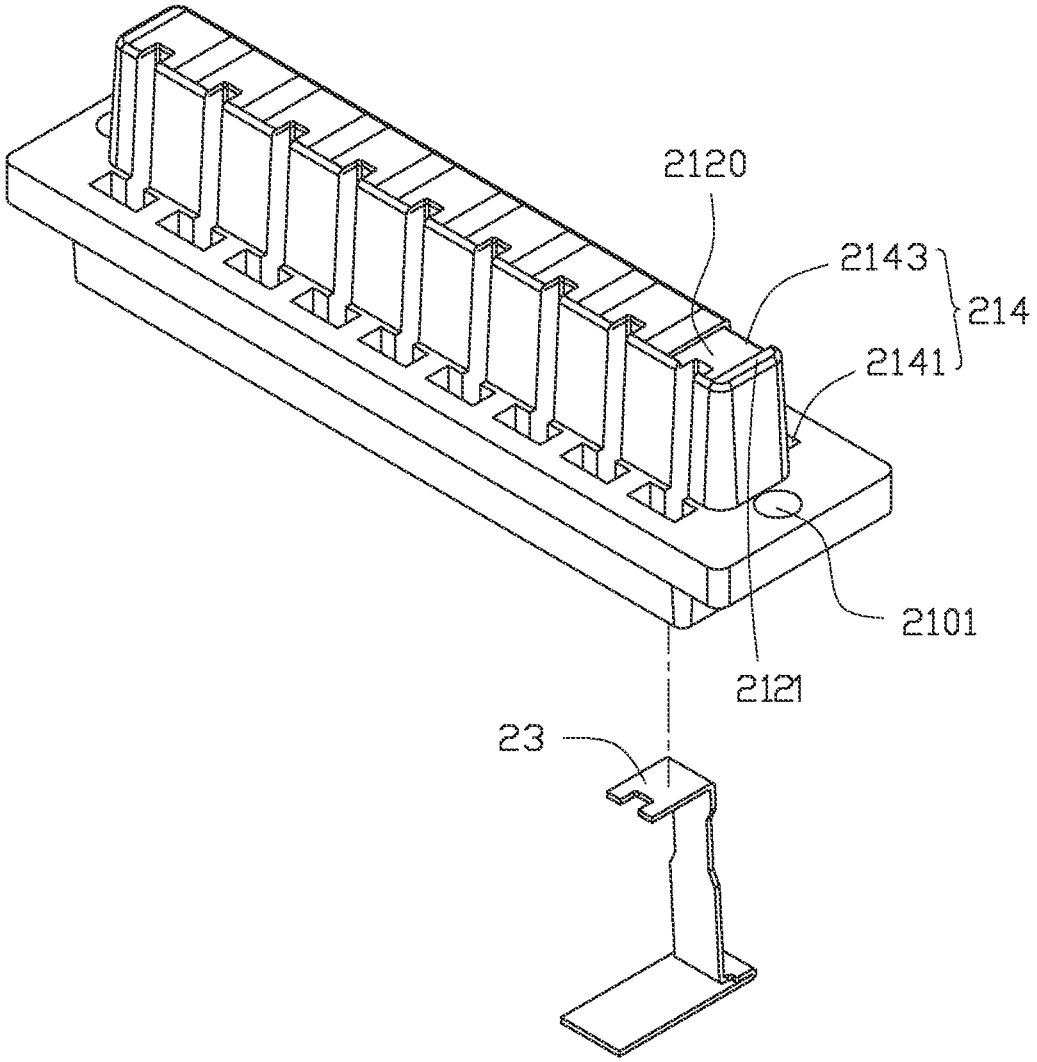
FIG. 4 is a similar view of the electrical connector in FIG. 3, but viewed from a different aspect.

FIG. 4 illustrates that each passageway 214 can include a through slot 2141 extending through the head portion 211 and the positioning body 210, and a groove 2143 defined in a sidewall of the tail portion 212. The through slot 2141 is coupled to the groove 2143. The through slot 2141 is coupled to the first concave 2110 of the head portion 211. The groove 2143 is communicating with the second concave 2120 of the tail portion 212.

FIG. 3 and FIG. 4 illustrate that each first terminal 23 can include a first contact portion 231, a second contact portion 232 and a retaining portion 233 coupling between the first contact portion 231 and the second contact portion 232. The first contact portion 231 is configured to be coupled to a first circuit board or electric device. The second contact portion 232 is configured to be coupled to a second circuit board or electric device. Each of the first contact portion 231, the second contact portion 232 and the retaining portion 233 can be a metal plate. Each first terminal 23 can be formed by bending an integral metal plate. Each first terminal 23 can have a resilient, elastic, and/or deformable configuration.

The first contact portion 231 is configured to be received in the first concave 2110 of the head portion 211 of the insulating housing 21. The first contact portion 231 can be rectangular in shape. The first contact portion 231 has a length greater than that of a front opening of the first concave 2110 of the head portion 211.

The second contact portion 232 is configured to be received in the second concave 2120 of the tail portion 212 of the insulating housing 21. The second contact portion 232 can be rectangular in shape. The second contact portion 232 can be substantially parallel to the first contact portion 231. The second contact portion 232 has a length less than that of the first contact portion 231. The second contact portion 232 has a width less than that of the first contact portion 231. The second contact portion 232 can define a cutout 2320 in a distal end thereof.

The retaining portion 233 is configured to be received in the passageway 214 of the insulating housing 21. In at least one embodiment, the retaining portion 233 is elastic, resilient, and/or deformable. The retaining portion 233 can include a first coupling portion 2331 coupled to the first contact portion 231 and a second coupling portion 2332 coupled between the first coupling portion 2331 and the second contact portion 232. The first coupling portion 2331 and the second coupling portion 2332 are noncoplanar. The first coupling portion 2331 can be parallel to the first contact portion 231. In at least one embodiment, the first coupling portion 2331 overlaps and is in direct physical contact a portion of the first contact portion 231. The first coupling portion 2331 can have a length less than that of each of the first contact portion 231 and the second contact portion 232. The first coupling portion 2331 can have a width substantially equal to that of the first contact portion 231. The second coupling portion 2332 depends from first coupling portion 2331. The second coupling portion 2332 has a width substantially equal to that of the second contact portion 232. The second coupling portion 2332 has two opposite sides defined two cutouts 2333 adjacent to the second contact portion 232. In at least one embodiment, the second coupling portion 2332 is substantially perpendicular to the first contact portion 231 and the second contact portion 232.

Figure 5:
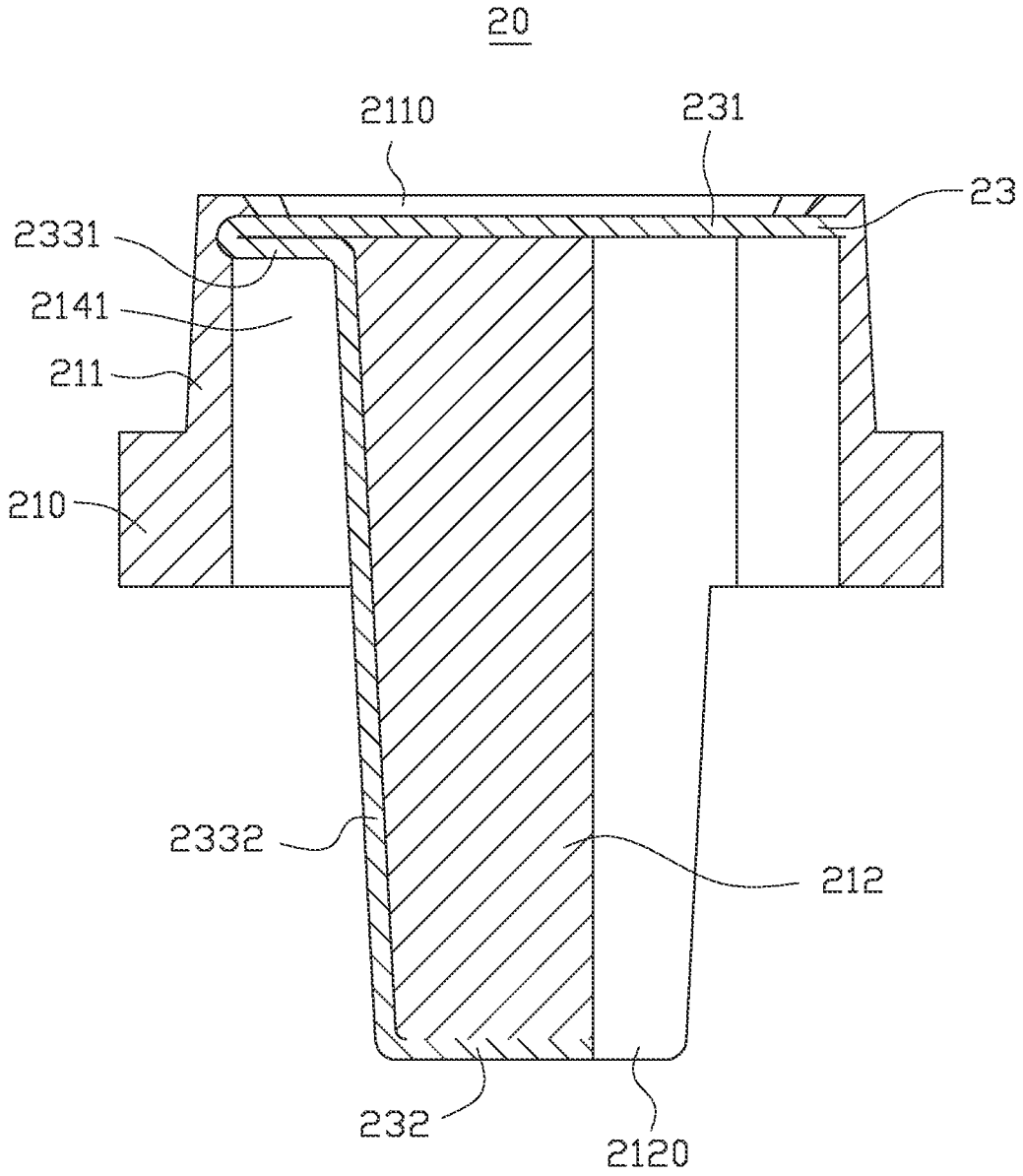
FIG. 5 is a cross sectional view of the electrical connector in FIG. 3, taken along a line V-V.

FIG. 5 illustrates an assembled configuration of the electrical connector 20, and the first terminal 23 is coupled to the insulating housing 21. The first contact portion 231 of the first terminal 23 is received in the first concave 2110 of the head portion 211 of the insulating housing 21 and is pressed by the head portion 211 in the first concave 2110. The second contact portion 232 of the first terminal 23 is received in the second concave 2120 of the tail portion 212 of the insulating housing 21. The first coupling portion 2331 of the retaining portion 233 is received in the through slot 2141 of the passageway 214 of the insulating housing 21. The second coupling portion 2332 of the retaining portion 233 is received in the groove 2143 (shown in FIG. 4) of the passageway 214.

In assembling the electrical connector 20 to the installing housing 10, the positioning body 210 of the insulating housing 21 of the electric connector 20 is positioned on the support face 110 of the conterbore structure 11 of the installing housing 10. The positioning body 210 is fitly received in the opening 111 of the conterbore structure 11. The head portion 211 is received in the opening 111 of the conterbore structure 11. The tail portion 212 of the insulating housing 21 is received in the through hole 112 of the conterbore structure 11. The first contact portions 231 of the first terminal 23 are exposed in the opening 111. The second contact portions 231 of the first terminals 23 are exposed out of the through hole 112. Glue or plastic is filled in the through apertures 2101 of the positioning body 210 and located between the positioning body 210 and the support face 110 to bond the electrical connector 20 and the installing housing 10 together.

Figure 6:
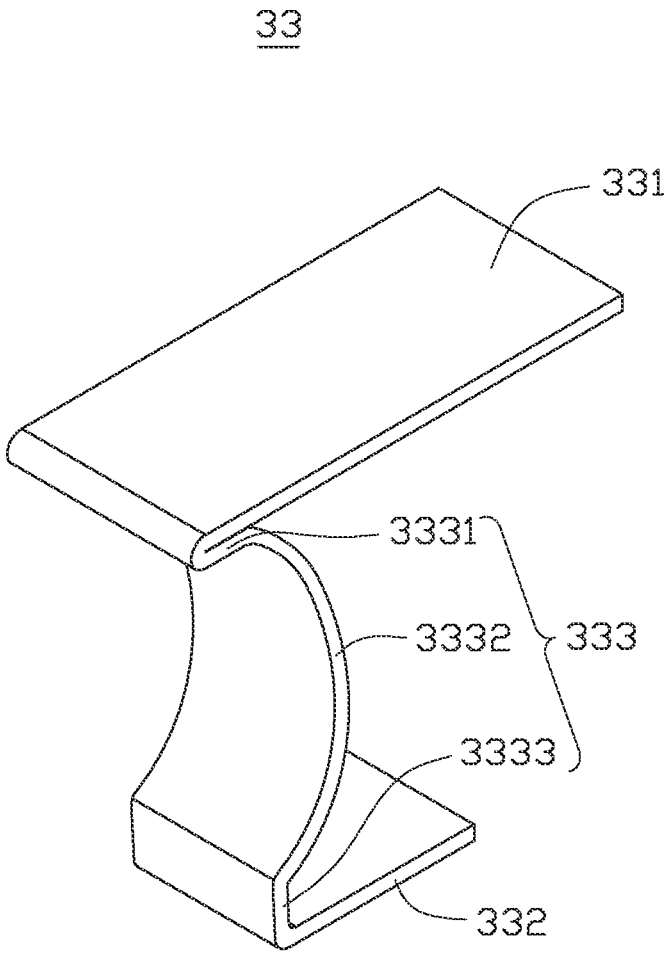
FIG. 6 is an isometric view of a second terminal which can replace the first terminal of the electrical connector in FIG. 3.

FIG. 6 illustrates a second terminal 33 can replacing the first terminal 23. The second terminal 33 can be directly deformed from the first terminal 23. In at least one embodiment, the second terminal 33 has a configuration similar to that of the first terminal 23. The second terminal 33 can include a first contact portion 331, a second contact portion 332 and a retaining portion 333 coupling between the first contact portion 331 and the second contact portion 332. The first contact portion 331 is configured to be coupled to a first circuit board or electric device. The second contact portion 332 is configured to be coupled to a second circuit board or electric device. Each of the first contact portion 331, the second contact portion 332 and the retaining portion 333 can be a metal plate. Each second terminal 33 can be formed by bending an integral metal plate. Each second terminal 33 can have a resilient, elastic, and/or deformable configuration.

The first contact portion 331 is configured to be received in the first concave 2110 of the head portion 211 of the insulating housing 21. The first contact portion 331 can be rectangular in shape. The first contact portion 331 has a length greater than that of a front opening of the first concave 2110 of the head portion 211.

The second contact portion 332 is configured to be received in the second concave 2120 of the tail portion 212 of the insulating housing 21. The second contact portion 332 can be rectangular in shape. The second contact portion 332 can be substantially parallel to the first contact portion 331. The second contact portion 332 has a length less than that of the first contact portion 331. The second contact portion 332 has a width less than that of the first contact portion 331.

The retaining portion 333 is configured to be received in the passageway 214 of the insulating housing 21. In at least one embodiment, the retaining portion 333 is elastic or resilient or deformable. The retaining portion 333 can include a first coupling portion 3331 coupled to the first contact portion 331, a second coupling portion 3332 and a third coupling portion 3333 coupled to the second contact portion 332. The first coupling portion 3331 and the second coupling portion 3332 are noncoplanar. The first coupling portion 3331 can be parallel to the first contact portion 331. In at least one embodiment, the first coupling portion 3331 overlaps and is in direct physical contact with a portion of the first contact portion 331. The first coupling portion 3331 can have a length less than that of each of the first contact portion 331 and the second contact portion 332. The first coupling portion 3331 can have a width substantially equal to that of the first contact portion 331. The second coupling portion 3332 is coupled between the first coupling portion 3331 and the second contact portion 332. In at least one embodiment, the second coupling portion 3332 is curved and located between the first contact portion 331 and the second contact portion 332. The second coupling portion 3332 has a width substantially equal to that of the second contact portion 332. The third coupling portion 3333 is coupled between the second coupling portion 3332 and the second contact portion 332. The third coupling portion 3333 is substantially perpendicular to the second contact portion 332. The third coupling portion 3333 has a width substantially equal to that of the second contact portion 332.

Figure 7:
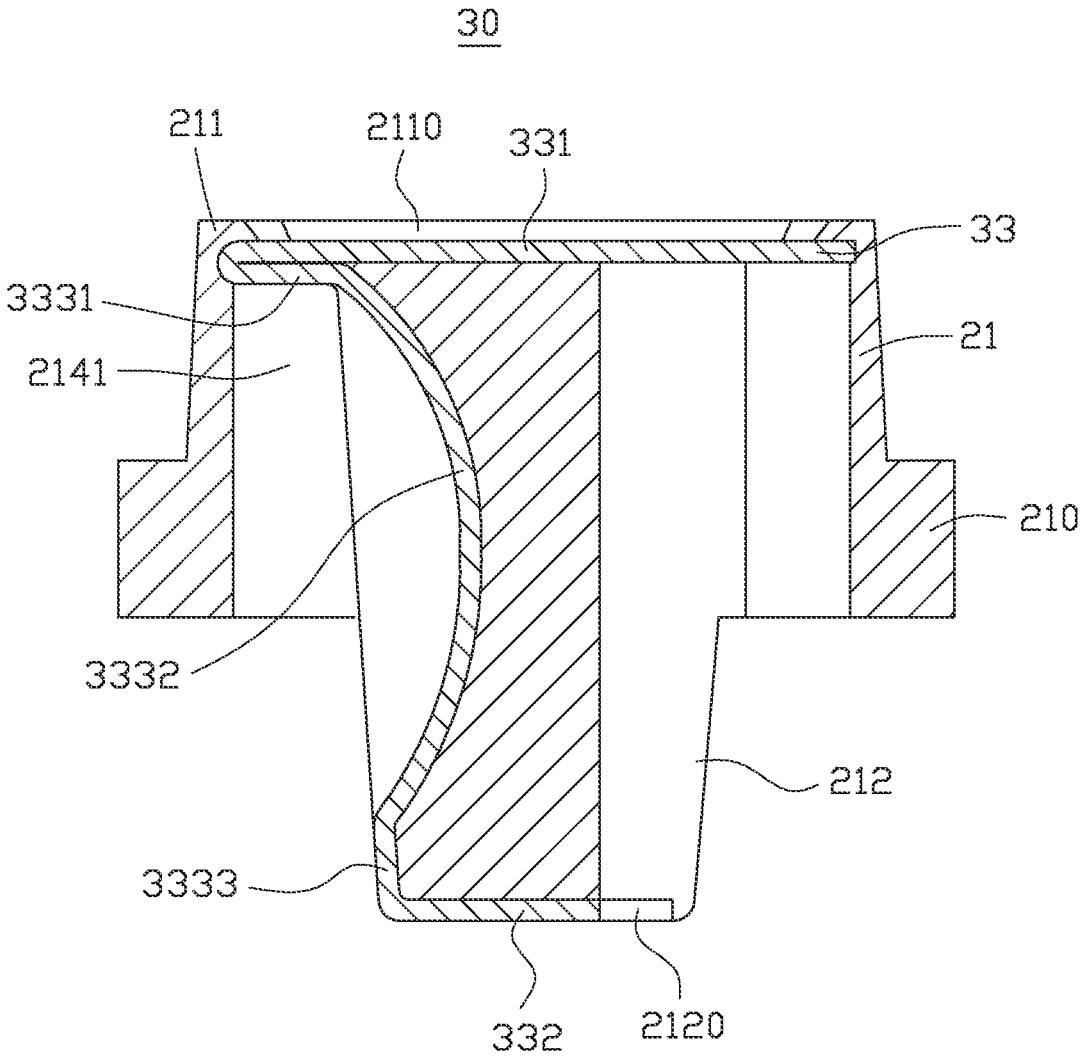
FIG. 7 is a cross sectional view of an electrical connector with the second terminal in FIG. 6.

FIG. 7 illustrates an assembled configuration of an electrical connector 30 using the second terminal 33 second terminal 33 that is coupled to the insulating housing 21. The first contact portion 331 of the second terminal 33 is received in the first concave 2110 of the head portion 211 of the insulating housing 21 and is pressed by the head portion 211 in the first concave 2110. The second contact portion 332 of the second terminal 33 is received in the second concave 2120 of the tail portion 212 of the insulating housing 21. The first coupling portion 3331 of the retaining portion 333 is received in the through slot 2141 of the passageway 214 of the insulating housing 21. The second coupling portion 3332 and the third coupling portion 3333 of the retaining portion 333 are received in the groove 2143 (shown in FIG. 4) of the passageway 214.

Figure 8:
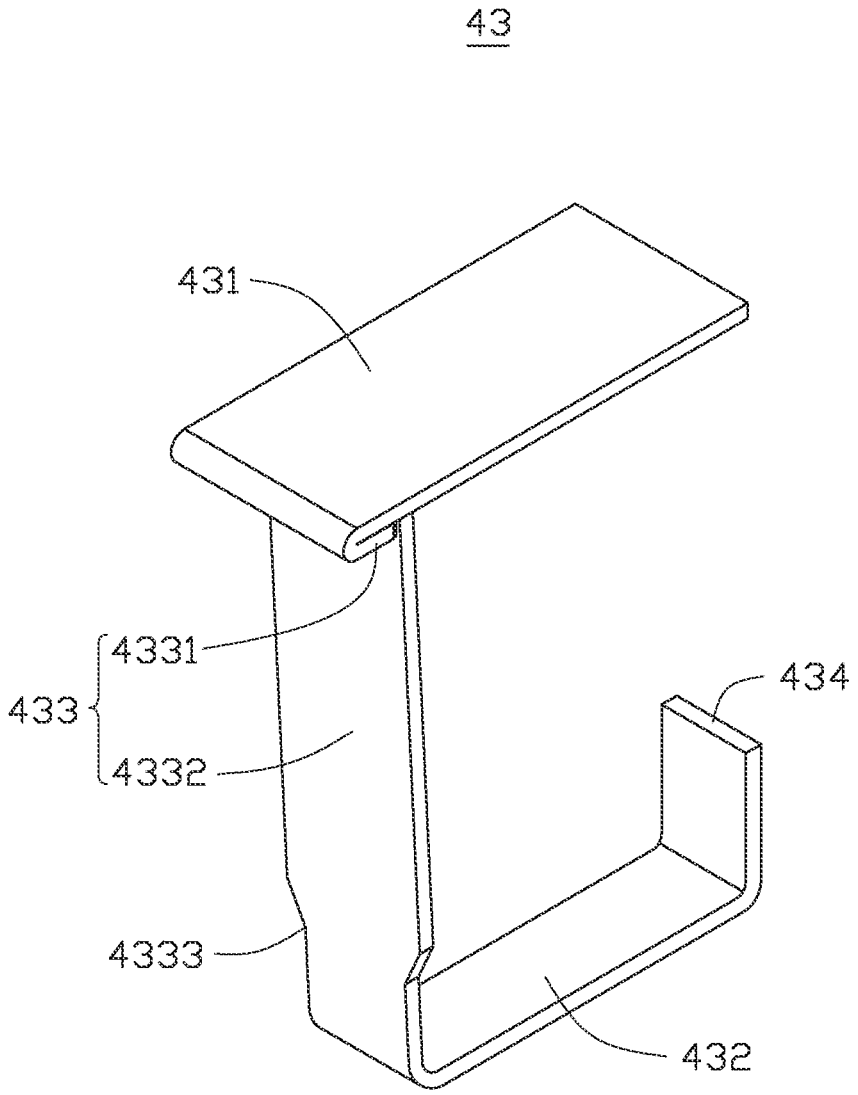
FIG. 8 is an isometric view of third terminal which can replace the first terminal of the electrical connector in FIG. 3.

FIG. 8 illustrates a third terminal 43 replacing the first terminal 23. The third terminal 43 can include a first contact portion 431, a second contact portion 432, a retaining portion 433 coupling the first contact portion 431 and the second contact portion 432, and a third contact portion 434 bending from a distal end of the retaining portion 433. The first contact portion 431 is configured to be coupled to a first circuit board or electric device. The third contact portion 434 is configured to be coupled to a second circuit board or electric device. Each of the first contact portion 431, the second contact portion 432, the retaining portion 433 and the third contact portion 434 can be a metal plate. Each third terminal 43 can be formed by bending an integral metal plate. Each third terminal 43 can have a resilient, elastic, and/or deformable configuration.

The first contact portion 431 is configured to be received in the first concave 2110 of the head portion 211 of the insulating housing 21. The first contact portion 431 can be rectangular in shape. The first contact portion 431 has a length greater than that of a front opening of the first concave 2110 of the head portion 211.

The second contact portion 432 is configured to be received in the second concave 2120 of the tail portion 212 of the insulating housing 21. The second contact portion 432 can be rectangular in shape. The second contact portion 432 can be substantially parallel to the first contact portion 431. The second contact portion 432 has a length less than that of the first contact portion 431. The second contact portion 432 has a width less than that of the first contact portion 431. The second contact portion 432 can define a cutout 4320 in a distal end thereof.

The retaining portion 433 is configured to be received in the passageway 214 of the insulating housing 21. In at least one embodiment, the retaining portion 233 is elastic, resilient, and/or deformable. The retaining portion 433 can include a first coupling portion 4331 coupled to the first contact portion 431 and a second coupling portion 4332 coupled between the first coupling portion 4331 and the second contact portion 432. The first coupling portion 4331 and the second coupling portion 4332 are noncoplanar. The first coupling portion 4331 can be parallel to the first contact portion 431. In at least one embodiment, the first coupling portion 4331 overlaps and is in direct physical contact a portion of the first contact portion 431. The first coupling portion 4331 can have a length less than that of each of the first contact portion 431 and the second contact portion 432. The first coupling portion 4331 can have a width substantially equal to that of the first contact portion 431. The second coupling portion 4332 is depending from first coupling portion 4331. The second coupling portion 4332 has a width substantially equal to that of the second contact portion 432. The second coupling portion 4332 has two opposite sides defined two cutouts 4333 adjacent to the second contact portion 432. In at least one embodiment, the second coupling portion 4332 is substantially perpendicular to the first contact portion 431 and the second contact portion 432.

The third contact portion 434 can be rectangular in shape. The third contact portion 434 has a length less than that of the first contact portion 431. The third contact portion 434 has a width less than that of the first contact portion 431. The third contact portion 434 can substantially perpendicular to first contact portion 431 and the second contact portion 432. The third contact portion 434 can be positioned to a sidewall of the tail portion 212 of the insulating housing 21.

Figure 9:
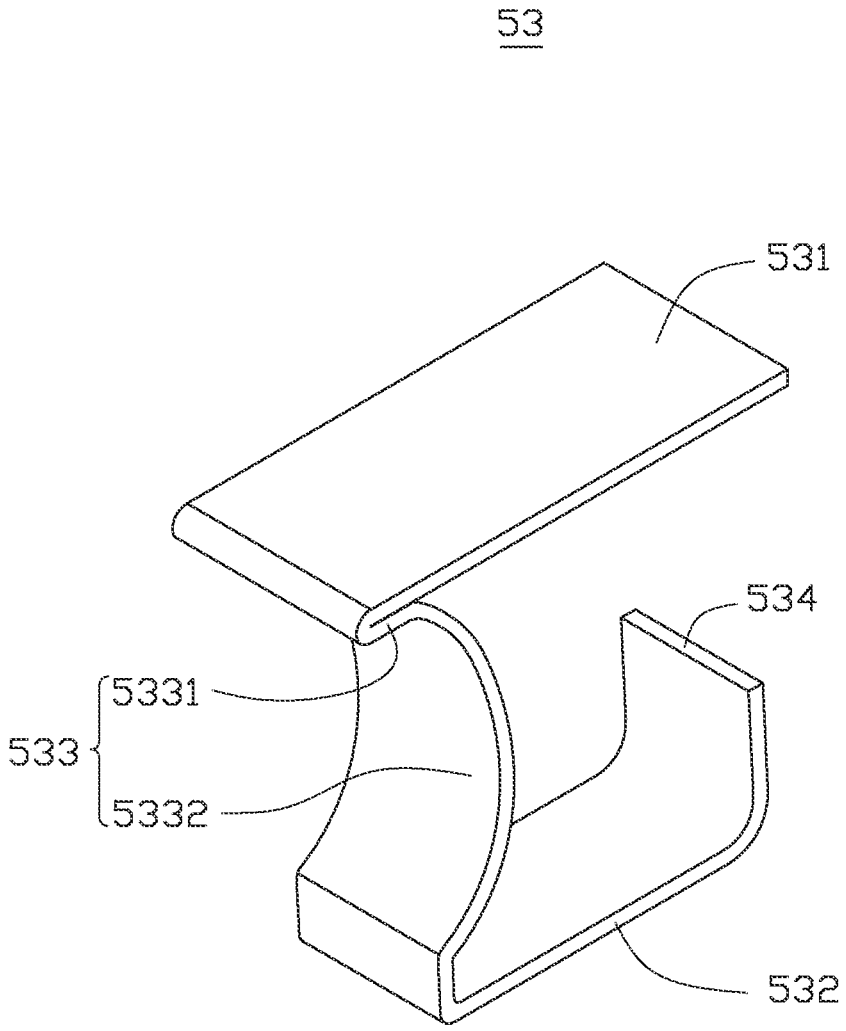
FIG. 9 is an isometric view of a fourth terminal which can replace the first terminal of the electrical connector in FIG. 3.

FIG. 9 illustrates a fourth terminal 53 can replacing the first terminal 23. The fourth terminal 53 can be directly deformed from the third terminal 43. In at least one embodiment, the fourth terminal 53 has a configuration similar to that of the third terminal 43. The fourth terminal 53 can include a first contact portion 531, a second contact portion 532, a retaining portion 533 coupling the first contact portion 531 and the second contact portion 532, and a third contact portion 534 bending from a distal end of the retaining portion 533. The first contact portion 531 is configured to be coupled to a first circuit board or electric device. The third contact portion 534 is configured to be coupled to a second circuit board or electric device. Each of the first contact portion 531, the second contact portion 532, the retaining portion 533 and the third contact portion 534 can be a metal plate. Each fourth terminal 53 can be formed by bending an integral metal plate. Each fourth terminal 53 can have a resilient, elastic, and/or deformable configuration.

The first contact portion 531 is configured to be received in the first concave 2110 of the head portion 211 of the insulating housing 21. The first contact portion 531 can be rectangular in shape. The first contact portion 531 has a length greater than that of a front opening of the first concave 2110 of the head portion 211.

The second contact portion 532 is configured to be received in the second concave 2120 of the tail portion 212 of the insulating housing 21. The second contact portion 532 can be rectangular in shape. The second contact portion 532 can be substantially parallel to the first contact portion 531. The second contact portion 532 has a length less than that of the first contact portion 531. The second contact portion 532 has a width less than that of the first contact portion 531.

The retaining portion 533 is configured to be received in the passageway 214 of the insulating housing 21. The retaining portion 533 can include a first coupling portion 5331 coupled to the first contact portion 531, and a second coupling portion 5332 coupled to the second contact portion 532. The first coupling portion 5331 and the second coupling portion 5332 are noncoplanar. The first coupling portion 5331 can be parallel to the first contact portion 531. In at least one embodiment, the first coupling portion 5331 overlaps and is in direct physical contact with a portion of the first contact portion 531. The first coupling portion 5331 can have a length less than that of each of the first contact portion 531 and the second contact portion 532. The first coupling portion 5331 can have a width substantially equal to that of the first contact portion 531. In at least one embodiment, the second coupling portion 5332 is curved and located between the first contact portion 531 and the second contact portion 532. The second coupling portion 5332 has a width substantially equal to that of the second contact portion 532.

The third contact portion 534 can be rectangular in shape. The third contact portion 534 has a length less than that of the first contact portion 531. The third contact portion 534 has a width less than that of the first contact portion 531. The third contact portion 534 can substantially perpendicular to first contact portion 531 and the second contact portion 532. The third contact portion 534 can be positioned to a sidewall of the tail portion 212 of the insulating housing 21.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An electrical connector comprising:

an insulating housing comprising a positioning body having a first face and a second face opposite the first face, a head portion extending from the first face, and a tail portion extending from the second face; and a plurality of terminals coupled to the insulating housing, each of the plurality of terminals comprising:

a first contact portion configured to be coupled to a first circuit board or electronic device, a second contact portion configured to be coupled to a second circuit board or electronic device, and a retaining portion coupled between the first contact portion and the second contact portion and comprising a first coupling portion coupled to the first contact portion and a second coupling portion coupled between the first coupling portion and the second contact portion, the first coupling portion and the second coupling portion being non-coplanar;

wherein the first contact portion is coupled to a first positioning face of the head portion of the insulating housing, the second contact portion is coupled to a second positioning face of the tail portion of the insulating housing, and the retaining portion extends from the head portion to the tail portion; wherein the head portion defines a first concave at the first positioning face remote from the positioning body, the first contact portion being received in the first concave.

2. The electrical connector of claim 1, wherein each of the first contact portion, the second contact portion and the retaining portion is a metal plate.

3. The electrical connector of claim 1, wherein the first contact portion is parallel to the second contact portion.

4. The electrical connector of claim 3, wherein each of the terminals further comprises a third contact portion coupled to the second contact portion and a sidewall of the tail portion.

5. The electrical connector of claim 1, wherein the first coupling portion is parallel to the first contact portion.

6. The electrical connector of claim 5, wherein the first coupling portion overlaps a portion of the first contact portion.

7. The electrical connector of claim 5, wherein the second coupling portion is perpendicular to the second contact portion.

8. The electrical connector of claim 5, wherein the second coupling portion is curved and located between the first contact portion and the second contact portion.

9. The electrical connector of claim 8, wherein the retaining portion further comprises a third coupling portion coupled with the second coupling portion and the second contact portion, the third coupling portion being perpendicular to the second contact portion.

10. The electrical connector of claim 1, wherein the insulating housing defines an array of passageways extending through the insulating housing from the head portion to the tail portion, retaining portions of the terminals being received in the passageways respectively.

11. The electrical connector of claim 10, wherein each of the passageways comprises a through slot extending through the head portion and the positioning portion, and a groove defined in a sidewall of the tail portion.

12. The electrical connector of claim 11, wherein the first coupling portion of the retaining portion is received in the through slot of the passageway, the second coupling portion of the retaining portion being received in the groove of the passageway.

13. The electrical connector of claim 1, wherein the tail portion defines a second concave at the second positioning face remote from the positioning body, the second contact portion being received in the second concave.

14. The electrical connector of claim 13, wherein the first positioning face of the head portion is parallel to the second positioning face of the tail portion.

15. An electronic system comprising:

an installing housing comprising a support face, an opening on the support face and a through hole below the support face and communicating with the opening; and an electrical connector coupled to the installing housing, the electrical connector comprising:

an insulating housing comprising a positioning body positioned on the support face and received in the opening, a head portion extending from a first face of the positioning body and received in the opening, and a tail portion extending from a second face of the positioning body opposite to the first face and received in the through hole; and a plurality of terminals coupled to the insulating housing, each of the terminals comprising a first contact portion configured to be coupled to a first circuit board or electronic device, a second contact portion configured to be coupled to a second circuit board or electronic device, and a retaining portion coupled between the first contact portion and the second contact portion;

wherein the first contact portion is coupled to a face of the head portion of the insulating housing, the second contact portion is coupled to a face of the tail portion of the insulating housing, and the retaining portion extends from the head portion to the tail portion.

16. The electronic system of claim 15, wherein the positioning body defines a through aperture extending through the first face and the second face of the positioning portion of the insulating housing, glue or plastic being filled in the through aperture to bond the insulating housing and the installing housing together.

17. The electronic system of claim 15, wherein the opening is greater than the through hole in size.

18. The electronic system of claim 17, wherein the positioning portion is greater than each of the head portion and the tail portion in size.

19. The electronic system of claim 15, wherein the retaining portion comprises a first coupling portion coupled to the first contact portion and a second coupling portion coupled between the first coupling portion and the second contact portion, the first coupling portion and the second coupling portion being non-coplanar.

* * * * *